US006922980B2

(12) United States Patent
Cere'

(10) Patent No.: US 6,922,980 B2
(45) Date of Patent: Aug. 2, 2005

(54) APPARATUS FOR MAKING A TUBULAR LENGTH OF STRETCH FILM

(75) Inventor: Mauro Cere' , Loiano (IT)

(73) Assignee: Aetna Group, S.p.A., Rimini (IT)

( * ) Notice: Subject to any disclaimer, the term of this patent is extended or adjusted under 35 U.S.C. 154(b) by 0 days.

(21) Appl. No.: 10/727,785

(22) Filed: Dec. 4, 2003

(65) Prior Publication Data

US 2004/0107678 A1 Jun. 10, 2004

(30) Foreign Application Priority Data

Dec. 6, 2002 (IT) ..... BO2002A0768

(51) Int. Cl.[7] ..... B65B 11/00

(52) U.S. Cl. ..... 53/588; 53/441; 53/556; 53/589

(58) Field of Search ..... 53/210, 449, 556, 53/582, 586, 588, 589, 590

(56) References Cited

U.S. PATENT DOCUMENTS

| | | | | |
|---|---|---|---|---|
| 2,864,212 A | | 12/1958 | Bruce | |
| 3,540,187 A | * | 11/1970 | Monaghan | 53/74 |
| 3,777,452 A | * | 12/1973 | Koenders | 53/206 |
| 3,999,357 A | * | 12/1976 | Marantz | 53/442 |
| 4,083,163 A | * | 4/1978 | Ganz | 53/48.2 |
| 4,633,647 A | * | 1/1987 | Ganz | 53/398 |
| 4,730,436 A | | 3/1988 | Angelino | |
| 5,473,861 A | * | 12/1995 | Fukunaga et al. | 53/441 |
| 5,619,843 A | * | 4/1997 | Ganz | 53/543 |
| 6,128,888 A | * | 10/2000 | Gambetti | 53/465 |
| 2003/0024213 A1 | | 2/2003 | Cere' | |

FOREIGN PATENT DOCUMENTS

| | | |
|---|---|---|
| EP | 0 354 083 | 2/1990 |
| EP | 1 288 127 A1 | 3/2003 |
| EP | 1 288 127 | 3/2003 |

OTHER PUBLICATIONS

European Search Report correspondence to EP Application No. EP 03 42 5757.

* cited by examiner

*Primary Examiner*—Stephen Gerrity
*Assistant Examiner*—Thanh Truong
(74) *Attorney, Agent, or Firm*—Fay, Sharpe, Fagan, Minnich & McKee, LLP

(57) ABSTRACT

An apparatus for making a tubular length (1) of stretch film is applicable to machines or lines (3) for making packages (C) containing groups of products wrapped with stretch film and comprises at least the following: a feed table (4), extending in a defined direction (D), on which the groups of products presenting a front face (5) are formed; a station (6) for making the packages (C), located on the feed table (4) and equipped with means (7) for unwinding the stretch film and forming the length (1) of the film around means (8) for preforming the package (C), the means (7) for unwinding and forming the length (1) of film comprising at least one roll (9) of stretch film located close to the preforming means (8); means (10) for cutting a length of the film unwound from the roll (9); means (11) for gripping the film and moving along a substantially ring-shaped path (P) in such a way as to wind the film around the package (C) preforming means (8) and place the leading and trailing ends (1*a*, 1*b*) of the length (1) of film into contact with each other; and a unit (12) for stably joining the ends (1*a*, 1*b*) together to form a tubular length (1) of film around the preforming means (8).

12 Claims, 2 Drawing Sheets

APPARATUS FOR MAKING A TUBULAR LENGTH OF STRETCH FILM

BACKGROUND OF THE INVENTION

The present invention relates to an apparatus for making a tubular length of stretch film.

More specifically, the tubular length of film is used to wrap packages containing groups of products such as bottles with bases of different shapes—for example, circular, square or rectangular—or even containers made of metal (including parallelepiped shaped containers).

At present, in the packaging of groups of plastic bottles (to which the present description will hereinafter refer, although the invention may also be applied to other types of product or container), the final wrapping over the groups of bottles usually consists of a sheet of heat-shrink or stretch film.

In some cases and for some types of products, packaging lines that use heat-shrink film may, however, be very expensive for the manufacturer for a number of reasons: each line must have several different operating units, such as product collating units (especially in the case of continuous lines), and film feed and heating units. Moreover, all these units require a large number of control devices and accessory parts.

Other negative factors to be taken into account when dealing with packaging lines of this kind are the high cost of the heat shrink film itself and the fact that some products cannot be heated beyond certain limits, which means that heat shrink wrapping solutions are not feasible.

Wrapping machinery and methods that use stretch film, on the other hand, are more economical to run and have a simpler structure, while providing end products of the same quality as heat shrink wrapping lines.

In this connection, and in view also of the greatly increased demand for stretch wrapping, there has also been a growing demand for a new type of end package to meet changing consumer requirements and to facilitate handling.

One prior art solution that uses stretch film is described in European patent application No. 01830521.9 by the same Applicant as the present, where the stretch wrapping machine essentially comprises:

a feed table on which the groups of products presenting a front face and a longitudinal dimension are formed;

a first station for making the packages, located on and forming part of the feed table, and being equipped with first means for unwinding the stretch film and forming a length of the stretch film wound around first means for preforming the package located on the feed table and mobile between several working positions where the tubular length of film is stretched open wide, the group of products fed into it, and the wrapped package fed back out onto the feed line once the stretch film has shrunk back to its original size.

From this basic concept for a packaging line, to which at least one other station may be added to apply a second length of stretch film to the package that has already been wrapped once and turned through ninety degrees, the Applicant proceeded to the stage of actually constructing the operating stations forming part of the packaging line, including the station forming the subject matter of this invention and embodying the above mentioned first means for unwinding the stretch film to form the length of stretch film.

The present invention therefore has for an aim to provide an apparatus for making a tubular length of stretch film applicable to machines of the above mentioned type and having characteristics of high precision, adaptability to products of different shapes and sizes, and constructional simplicity, combined with speed of unwinding and positioning the film.

SUMMARY OF THE INVENTION

According to the invention, this aim is achieved by an apparatus for making a tubular length of stretch film applicable to machines or lines for making packages containing groups of products wrapped with stretch film, the apparatus comprising the following: a feed table, extending in a defined direction, on which the groups of products presenting a front face are formed; a station for making the packages, located on the feed table and equipped with means for unwinding the stretch film and forming the length of the film around means for preforming the package, the means for unwinding and forming the length of film comprising at least one roll of stretch film located close to the preforming means; means for cutting a length of the film unwound from the roll; means for gripping the film and moving along a substantially ring-shaped path in such a way as to wind the film around the package preforming means and place the leading and trailing ends of the length of film into contact with each other; and a unit for stably joining the ends together to form a tubular length of film around the preforming means.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DESCRIPTION OF THE PREFERRED EMBODIMENT

Figure 1:
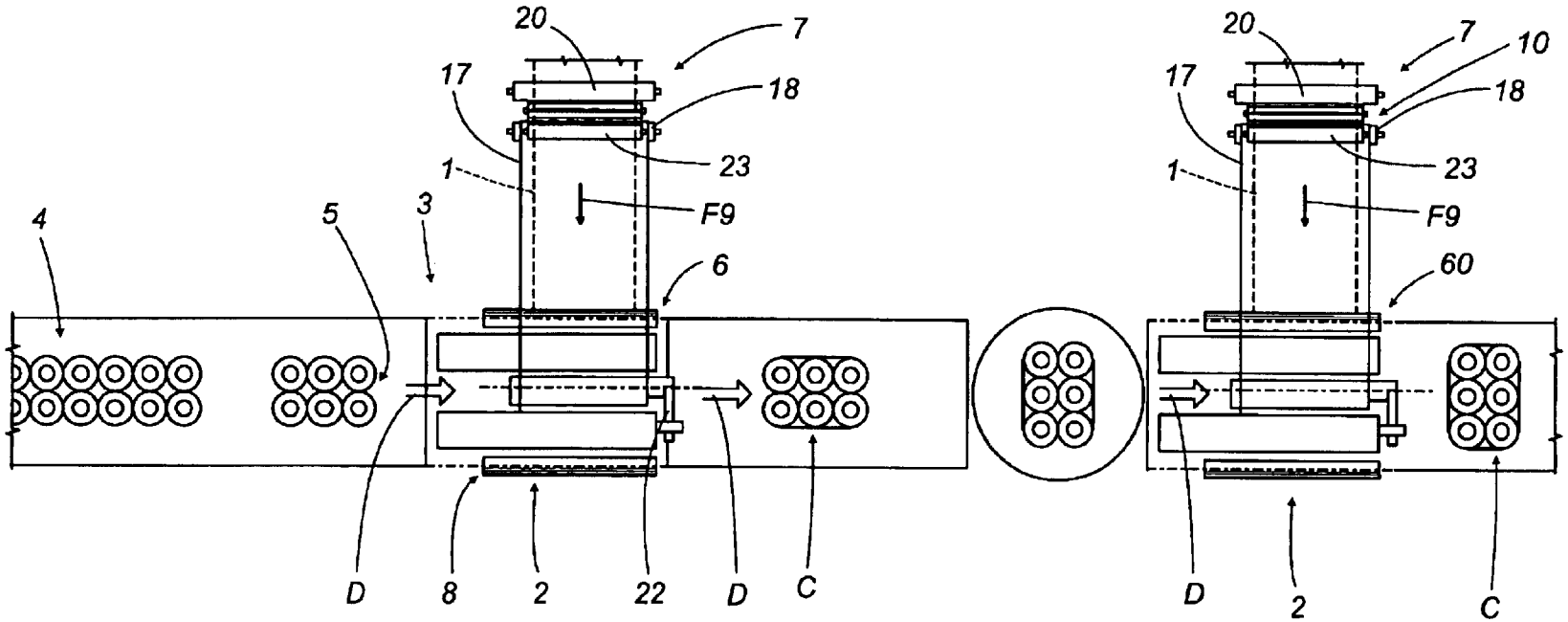
FIG. 1 is a schematic top plan view illustrating a machine for making wrapped packages containing groups of products and to which the apparatus according to the present invention for forming a tubular length of stretch film can be applied.

With reference to the accompanying drawings, in particular FIG. 1, the apparatus according to the invention, denoted in its entirety by the numeral 2, is used to form a tubular length 1 of film and is applicable to a machine or line 3 for making packages C containing groups of products wrapped with stretch film.

The machine 3, schematically illustrated in FIG. 1, comprises at least the following:

a feed table 4, extending in a defined direction indicated by the arrows D, on which the groups of products presenting a front face 5 are formed;

a station 6 for making the packages C, located on the feed table 4 and forming part of the feed table 4 itself.

Certain parts of the station 6 such as the preforming means 8 are not described in detail, since the station is fully described in European patent application No. 01830521.9, in the name of the same Applicant as the present.

The present invention is, instead, concerned in particular with the part of the station 6, denoted by the numeral 7, constituting means, located on the feed table 4, for unwinding the stretch film and forming a length 1 of the film around the means 8 that preform the package C.

The preforming means 8 (consisting essentially of four cylinders, illustrated schematically, of which at least two are mobile towards and away from respective fixed cylinders) move between different operating positions in order to stretch the length 1 of film in such a way that its cross section is larger than the front face 5 of the group of products, thus enabling the latter to be fed into the station 6 and, after being wrapped to form the package C, to be fed back out onto the feed table 4. The package C is fed out, again as described in European patent application No. 01830521.9, after the length 1 of film positioned around the group of products has been released.

Again with reference to FIG. 1, the machine 3 may include a second station 60 located downstream of, and being structurally similar to, the station 6. This second station is designed to complete the package C by wrapping the package C, after the latter has been rotated through an angle $\alpha$, with another length of film.

Figure 2:
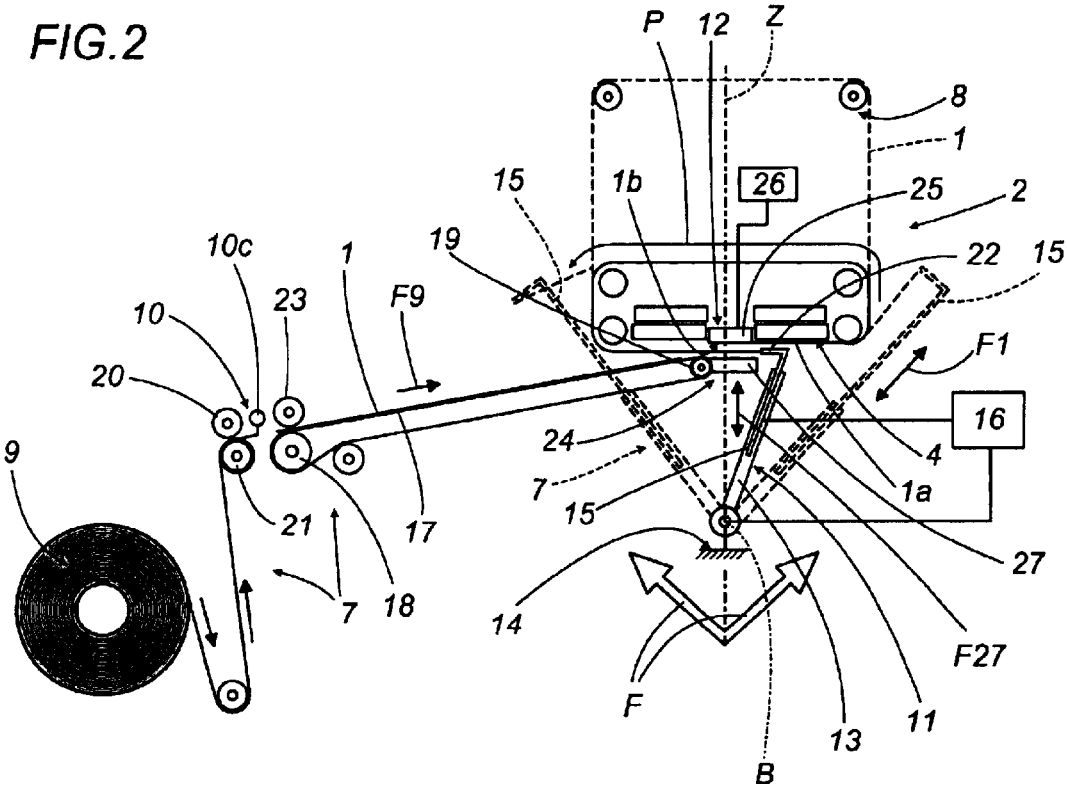
FIG. 2 is a schematic front view, with some parts cut away in order to better illustrate others, of the apparatus of FIG. 1 for forming a tubular length of stretch film.
Figure 3:
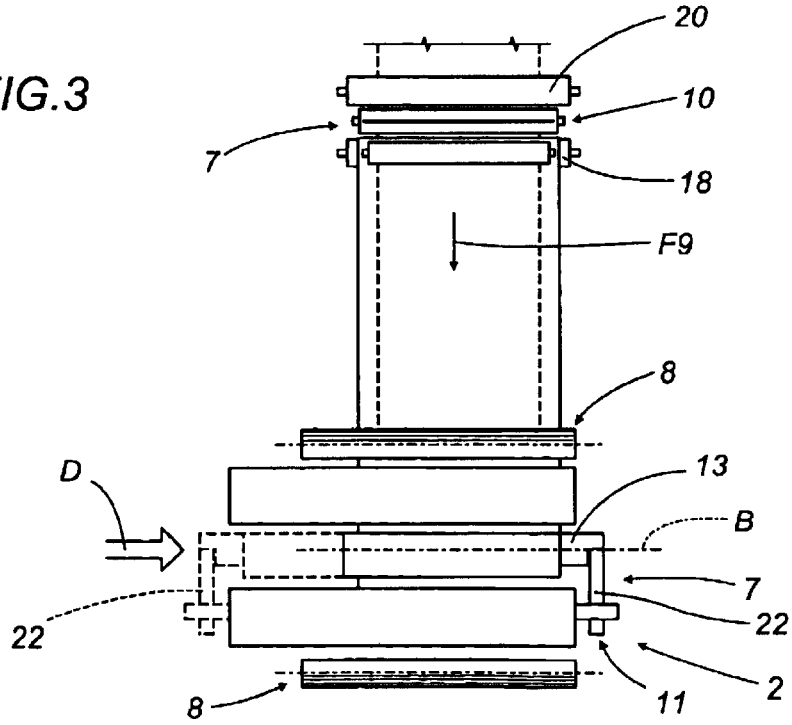
FIG. 3 is a schematic top plan view of the apparatus of FIG. 2.

With reference to FIGS. 2 and 3, the means 7 for unwinding and forming the length 1 of film comprise at least the following:

a roll 9 of stretch film located near the means 8 for preforming the package C;

means 10 for cutting a length 1 of the film unwound from the roll 9 and located upstream of the preforming means 8;

means 11 for gripping the film and moving along a substantially ring-shaped path P in such a way as to wind the film around the package C preforming means 8 and place the leading and trailing ends 1*a* and 1*b* of the length 1 of film into contact with each other;

a unit 12, located close to the preforming means 8, for stably joining the ends 1*a* and 1*b* together to form the length 1 of film into a tubular shape around the preforming means 8.

Looking more closely at the technical details with reference to FIGS. 2 and 3, the gripping means 11 comprise a single gripper 22 for holding the leading end 1*a* of the film on one side. The gripper 22 is able to move along the ring-shaped path P around the preforming means since 8 it is positioned on one side of the preforming means 8, lying across the feed direction D.

In an alternative embodiment, the gripping means 11 may comprise a pair of grippers 22 and 22*a* for holding the leading end 1*a* of the film on both sides.

The grippers 22 and 22*a* (the latter being drawn with a broken line) are synchronized and move along the ring-shaped path P around, and on both sides of, the preforming means 8, in such a way that they lie across the feed direction D.

Both in the first and in the second embodiments just mentioned, each gripper 22 forms part of a telescopic unit comprising:

an actuating arm 13 pivoted at its lower end at B to a fixed supporting structure 14 in such way as to swing in both directions (see arrows F in FIG. 2) about a vertical axis Z coinciding with a line passing through the center of the preforming means 8;

a rod 15 slidably housed inside the arm 13 and equipped at its upper free end with the gripper 22 that holds the leading end 1*a*; the rod 15 is mobile (see arrow F1 of FIG. 2) between several working positions including at least one withdrawn position in which the rod 15 is inside the actuating arm 13, keeping the gripper 22 outside it, and an advanced position in which the rod 15 forms an extension of the arm 13;

synchronized drive means 16 acting on the arm 13 and on the rod 15 in such a way as to pull the film being held by the gripper 22 along the ring shaped path P around the preforming means 8.

The means 16, illustrated schematically as a block in FIG. 2 since they are well known in the trade, impart a combined movement to the arm 13 and rod 15 and, by interaction of the two movements at variable speed, make the film perform a well-defined cyclic path around the preforming means 8.

In the embodiment with two grippers 22 and 22*a*, the telescopic unit just described is substantially doubled, whilst the means 16 may be connected to the second arm 13 and to the second rod 15 through suitable transfer means.

Still with reference to FIGS. 2 and 3, the roll 9 and the cutting means 10 are located upstream of a film transporting surface 17 designed to convey the film close to the preforming means 8.

The film transporting surface comprises an endless belt 17 trained around at least one pair of rollers 18 and 19, of which at least one is motor driven in synchrony with the preforming means 8.

The cutting means 10 are located at the end of the belt 17 furthest from the preforming means 8.

The cutting means 10 comprise a circular knife 10*c* interposed between a first pair of rollers 20 and 21, that feed the film from the roll 9 in a direction F9 and are located just upstream of the knife 10*c*, and the end of the aforementioned belt 17, which is equipped with a film gripping roller 23 that faces the end of the belt 17: thus, the film is transported from the roll 9 to the preforming means 8 along a straight feed path and is cut to the required length 1 when the gripper 22 catches hold of one end of it.

During and after winding of the film length 1 around the preforming means 8, the unit 12 is activated to join together the free ends 1*a* and 1*b* of the film length 1, said unit comprising means 24 for sealing the free ends 1*a* and 1*b*, located under the preforming means 8.

The sealing means 24 comprise: a first, fixed sealing plate 25 positioned under the preforming means 8 at the vertical axis Z passing through the center of the preforming means 8; means 26 for generating a vacuum (illustrated schematically as a block FIG. 2), acting on the first plate 25 and designed to retain the end 1*b* (namely, the trailing end of the film length 1 in the direction of feed F9) while the rest of the film length 1 is wound around the preforming means 8; a second contact plate 27, facing the first plate 25 and mobile between an idle position, in which it is away from the first plate 25, and a sealing position in which the second plate 27 is in contact with the first plate 25 after the first end 1*a* has reached the end 1*b* (see arrow F27) and the two ends 1*a* and 1*b* of the film length 1 have overlapped.

The apparatus as described above therefore achieves the aforementioned aims thanks to an extremely practical and flexible structure which allows the station to be adapted to products of different shapes and sizes through quick and easy programming of the means for feeding, cutting and winding the length of film.

The components of the apparatus are distributed in such a way as to keep the overall dimensions within suitable limits and to be well integrated in the machine to which it is applied. Wrapping is performed at high speeds capable of meeting current production requirements. Moreover, the production cost of the apparatus is very reasonable.

The invention described has evident industrial applications and can be modified in several ways without thereby departing from the scope of the inventive concept. Moreover, all the details of the invention may be substituted by technically equivalent elements.

What is claimed is:

1. An apparatus for making a tubular length of stretch film, the apparatus being applicable to machines or lines for making packages containing groups of products wrapped with stretch film, and comprising:

a feed table, extending in a defined direction, on which the groups of products presenting a front face are formed;

a station for making the packages, located on the feed table and being equipped with means for unwinding the stretch film and forming the length of the film around package preforming means, located on the feed table and being mobile between several working positions in order to stretch the length of film for obtaining a cross section of the length of film larger than the front face of the group of products, thus enabling the group of products to be fed into the station and, after the package has been formed, to be fed out onto the feed table again;

wherein the means for unwinding and forming the film length comprise:

a roll of stretch film located near the means for preforming the package;

means for cutting a length of the film unwound from the roll and located upstream of the preforming means;

a telescopic unit comprising:

an actuating arm pivoted at its lower end to a fixed supporting structure for swinging about a vertical axis coinciding with a line passing through the center of the preforming means;

a rod slidably housed inside the arm and equipped at its upper free end with a gripper that holds a leading end of the film; the rod being mobile between several working positions from a withdrawn position in which the rod is inside the actuating arm, keeping the gripper outside it, and an advanced position in which the rod forms an extension of the arm;

synchronized drive means being provided to act on the arm and on the rod for pulling the film being held by the gripper along a ring shaped path around the preforming means;

the means for unwinding and forming the film length further comprising a unit, located close to the preforming means, for stably joining leading ends of the film together to form the length of film into a tubular shape around the preforming means.

2. The apparatus according to claim 1, wherein the roll and the cutting means are positioned upstream of a film transporting surface designed to convey the film close to the preforming means.

3. The apparatus according to claim 2, wherein the transporting surface comprises an endless belt trained around at least one pair of rollers, of which at least one is motor driven in synchrony with the preforming means; the cutting means being positioned at the end of the belt furthest away from the preforming means.

4. The apparatus according to claim 3, wherein the cutting means comprise a circular knife interposed between a first pair of rollers, that feed the film from the roll and are located upstream of the knife, and the end of the belt, which is equipped with a film gripping roller that faces the end of the belt.

5. The apparatus according to claim 1, wherein the unit for stably joining the leading ends of the film length comprises means for sealing the leading ends, located under the preforming means.

6. The apparatus according to claim 5, wherein the sealing means comprise:

a first, fixed sealing plate positioned under the preforming means at the vertical axis passing through the center of the preforming means;

means for generating a vacuum, acting on the first plate and designed to retain the end while the rest of the film length is being wound;

a second contact plate, facing the first plate and mobile between an idle position, in which it is away from the first plate, and a sealing position in which the second plate is in contact with the first plate after the two ends of the film length have overlapped.

7. An apparatus for making a tubular length of stretch film, the apparatus being applicable to machines or lines for making packages containing groups of products wrapped with stretch film, and comprising:

a feed table, extending in a defined direction, on which the groups of products presenting a front face are formed;

a station for making the packages, located on the feed table and being equipped with means for unwinding the stretch film and forming the length of the film around package preforming means, located on the feed table and being mobile between several working positions in order to stretch the length of film for obtaining a cross section of the length of film larger than the front face of the group of products, thus enabling the group of products to be fed into the station and, after the package has been formed, to be fed out onto the feed table again;

wherein the means for unwinding and forming the film length comprise:

a roll of stretch film located near the means for preforming the package;

means for cutting a length of the film unwound from the roll and located upstream of the preforming means;

two telescopic units each comprising:

an actuating arm pivoted at its lower end to a fixed supporting structure for swinging about a vertical axis coinciding with a line passing through the center of the preforming means;

a rod slidably housed inside the arm and equipped at its upper free end with a gripper that holds a leading end of the film; the rod being mobile between several working positions from a withdrawn position in which the rod is inside the actuating arm, keeping the gripper outside it, and an advanced position in which the rod forms an extension of the arm;

synchronized drive means being provided to act on at least one of the arms and on at least one of the rods for pulling the film being held on both sides by the grippers along a ring shaped path around the preforming means;

the means for unwinding and forming the film length further comprising a unit, located close to the preforming means, for stably joining leading ends of the film together to form the length of film into a tubular shape around the preforming means.

8. The apparatus according to claim 7, wherein the roll and the cutting means are positioned upstream of a film transporting surface designed to convey the film close to the preforming means.

9. The apparatus according to claim 8, wherein the transporting surface comprises an endless belt trained around at least one pair of rollers, of which at least one is motor driven in synchrony with the preforming means; the cutting means being positioned at the end of the belt furthest away from the preforming means.

10. The apparatus according to claim 9, wherein the cutting means comprise a circular knife interposed between a first pair of rollers, that feed the film from the roll and are located upstream of the knife, and the end of the belt, which is equipped with a film gripping roller that faces the end of the belt.

11. The apparatus according to claim 7, wherein the unit for stably joining the leading ends of the film length comprises means for sealing the leading ends, located under the preforming means.

12. The apparatus according to claim 11, wherein the sealing means comprise:

a first, fixed sealing plate positioned under the preforming means at the vertical axis passing through the center of the preforming means;

means for generating a vacuum, acting on the first plate and designed to retain the end while the rest of the film length is being wound;

a second contact plate, facing the first plate and, mobile between an idle position, in which it is away from the first plate, and a sealing position in which the second plate is in contact with the first plate after the two ends of the film length have overlapped.

* * * * *